US007752715B2

(12) United States Patent
Morgner et al.

(10) Patent No.: US 7,752,715 B2
(45) Date of Patent: Jul. 13, 2010

(54) PROCEDURE AND SYSTEM FOR OPENING AND PROPORTIONING SYNTHETIC MATERIAL

(75) Inventors: Jörg Morgner, Kürten (DE); Michael Bruhn, Bergisch Gladbach (DE)

(73) Assignee: Temafa Maschinenfabrik GmbH, Bergisch Gladbach (DE)

( * ) Notice: Subject to any disclaimer, the term of this patent is extended or adjusted under 35 U.S.C. 154(b) by 184 days.

(21) Appl. No.: 12/189,599

(22) Filed: Aug. 11, 2008

(65) Prior Publication Data

US 2009/0077770 A1 Mar. 26, 2009

(30) Foreign Application Priority Data

Aug. 17, 2007 (DE) ..... 10 2007 039 055

(51) Int. Cl.
*D01G 15/40* (2006.01)

(52) U.S. Cl. ..... 19/97.5; 19/105

(58) Field of Classification Search ..... 19/97.5, 19/105

See application file for complete search history.

(56) References Cited

U.S. PATENT DOCUMENTS 4,778,276 A * 10/1988 Meyer et al. ..... 366/2
5,257,438 A 11/1993 Faas et al.
5,575,039 A 11/1996 Leifeld et al.
5,586,365 A 12/1996 Leifeld et al.
5,816,504 A * 10/1998 Zuckschwerdt et al. ..... 239/373
6,085,389 A 7/2000 Brabant et al.
6,327,745 B1 12/2001 Franke
6,905,528 B2 6/2005 Rubenach
2005/0187422 A1 * 8/2005 Maschke ..... 600/3

OTHER PUBLICATIONS

German Patent Office Search Report, Apr. 16, 2008.

* cited by examiner

*Primary Examiner*—Shaun R Hurley
(74) *Attorney, Agent, or Firm*—Dority & Manning, P.A.

(57) ABSTRACT

A method and a device for opening and dosing fiber feeds the fiber material via a feeding shaft of an opening device. The fiber material is processed in a first opening step of a dosing opener and is fed without an interconnecting pneumatic means to the feeding shaft of a second opening step. A large-volume feeding shaft has been placed before the first opening device from which the fiber material is delivered to a feeding shaft with a considerably smaller volume that delivers the fiber material to a second opening device. Both opening devices and their associated feeding shafts are placed on top of one other.

15 Claims, 2 Drawing Sheets

3
10
$T_1$
12
1
11
13
20
$T_2$
21
22
2
4
23

PROCEDURE AND SYSTEM FOR OPENING AND PROPORTIONING SYNTHETIC MATERIAL

FIELD OF THE INVENTION

The present invention refers to a method for opening and dosing fiber material in which the fiber material is delivered through the feeding shaft of an opening device, and to a device for executing the method.

BACKGROUND

In fleece manufacturing, the uniform supply of material is the prerequisite for high fleece uniformity. To feed the carding machines, so-called flock feeders are utilized that usually work according to the double shaft principle (DE 44 34 251). A fan blows the fiber material prepared by the mixing and opening equipment via a distribution line in the large upper shaft (the so-called material reserve shaft of the flock feeder) in whose lower end the fiber material is grabbed by a feeding roller and fed into an opening roller. For secure guidance, spring-mounted individual segments of a collecting trough clamp the fiber material against the feeding roller and these individual segments adjust themselves automatically according to the respective fiber mass. The fiber mass that is presented to the opening roller in this way is then opened by the opening roller and transported to the lower shaft, the actual feeding shaft for the carding machines. This is generally supported by an air current. A feeding roller that works together with spring-loaded, segmented troughs that sample the strength of the material and regulate accordingly has been placed in the lower end of the feeding shaft. Since the quantity throughput of the fiber material depends on the density of the material, the filling level is maintained as constant as possible in the feeding shaft and an air current brings about a uniform compression.

Several devices have been known for improving the compression air current at the exit of the feeding shaft, such as the one described in EP 0 929 704. However, that invention has the problem of once again carrying the compression air current away from the feeding shaft and separating it from the fiber material, and of also maintaining a uniform compression over the entire width of the feeding shaft. It is especially when the fleece machine is working very fast (when more than 1,000 kg/h of material must be fed into it) that the known equipment is incapable of equalizing the respective fluctuations without changing the filling level significantly, both in the reserve shaft and in the feeding shaft, which leads to uneven density in the fiber material and therefore has a negative effect on the uniformity of the fleece.

To achieve a continuous flow of material for the current demand of the fleece carding machine, other inventions have placed a dosing opener before the flock feeder so the latter can be uncoupled from the mixing and opening equipment. Since experience has shown that this uncoupling depends on bale loading and opening, the placing of a dosing opener before the flock feeder greatly improves operational safety (see Trültzschler brochure "Technologie Scanfeed TF Beschickung Dosieröffner FD-S" [The Technology of Scanfeeding TF Loading of the Dosing Opener FD-S]). This dosing opener consists of a large-volume filling shaft into which the fiber material coming from the mixing and opening equipment is blown. Photoelectric barriers control the filling level and the respective demand of material to request it from the mixing and opening equipment. This large dosing opener is not suitable for large throughput quantities of fiber material, however, because the fluctuation of material that occurs in the tall, space-saving mixing and opening equipment placed before it causes large height differences that lead to uneven density in the fiber material. The compression air current foreseen to compensate for the fluctuations in height is incapable of satisfactorily compensating for the fluctuations in height and therefore in density.

SUMMARY OF THE INVENTION

The task of the invention is to develop a method and a device to make uniform fleece production possible, especially for large material throughputs even under fluctuations taking place while the material is being prepared. Additional objects and advantages of the invention will be set forth in part in the following description, or may be obvious from the description, or may be learned through practice of the invention.

The invention is based on the knowledge that a uniform fleece production depends, above all, on the continuous supply of fiber material having the same density. To accomplish this, a precise separation is, if possible, needed so finely separated fiber material can be distributed more evenly and also with a more uniform density because of the precise separation. On the other hand, the density is adversely influenced by more pronounced filling level fluctuations that cannot be fully compensated by the complex compression air current guidance system. The task of the invention is solved by the features of the methods and devices claimed herein.

The fiber material is separated very well by the two-step opening, and a kind of distortion or thinning of the fiber material occurs at the same time. This also makes the density of the fiber material more uniform. The large cross-sectional area of the feeding shaft placed before the first opening step makes a large stockpiling with low filling level possible, thus preventing filling level fluctuations. For the second opening step, only a considerably smaller filling shaft is needed because no pneumatic transportation distances are used and the next working machine to be loaded can be controlled very precisely. Delays caused by interconnecting pneumatic means of transportation are avoided and this allows one to maintain a very exact filling level in the following second feeding shaft. The constant low filling level in the second feeding shaft also maintains the compression of the fiber material largely constant and low. Complex compression air currents for compensating density fluctuations are thus easily prevented.

The device for carrying out this method has two opening steps arranged on top of one another to achieve significant space savings in spite of large reserve quantities. Pneumatic transportation devices are not needed any longer and the transportation delays caused by them are eliminated.

BRIEF DESCRIPTION OF THE DRAWINGS

Other details of the invention are described with the help of drawings, which show.

DETAILED DESCRIPTION

Figure 1:
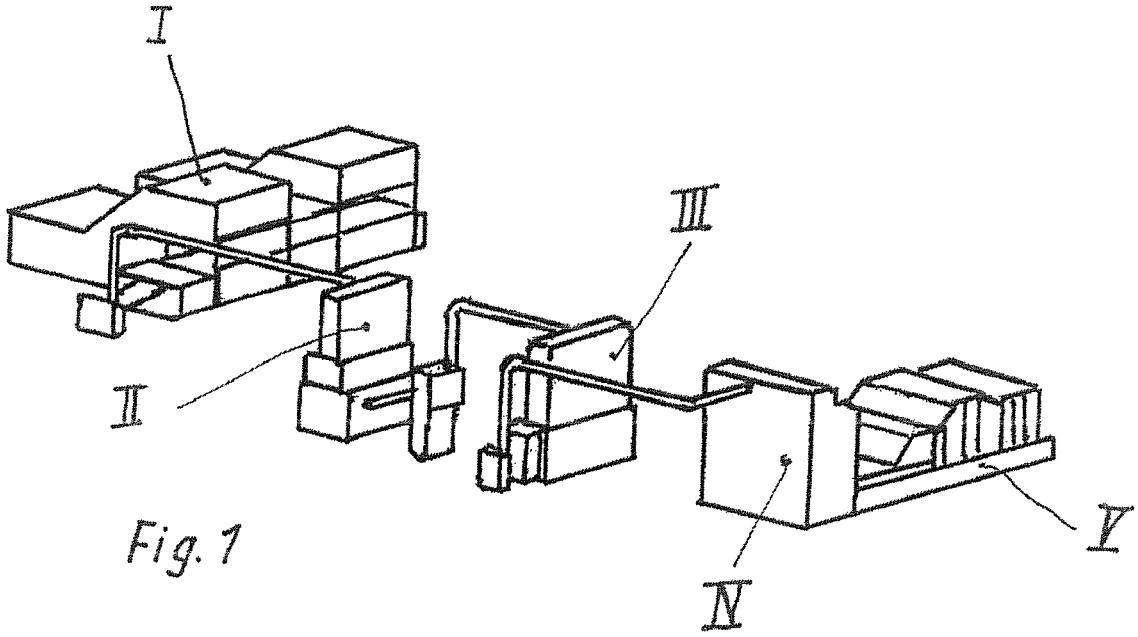
FIG. 1 A conventional opening and preparation equipment for producing fleece.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

FIG. 1 shows the customary equipment for preparing the fiber material for fleece production. The fiber material placed before it in the form of bales is opened via the opening and mixing equipment I and thrown into a conveyor belt so it can be supplied to the mixing opener II that starts separating the fiber material and mixing it further. From the mixing opener II, the fiber material reaches the fine opener III, where it undergoes a precise separation. Through conduits, the fiber material finally reaches the filling shaft feeder IV from which the carding machines V are fed. Every one of the machines II, III and IV have a narrow and high filling shaft that serves as buffer to compensate for supply fluctuations caused by the opening and mixing machines I. They are connected to each other by pneumatic transportation devices. Although the large construction height of the filling shafts needed for a sufficiently large reserve volume save space in the base, they have the disadvantage that large density differences in the supply of material caused by the material column take place while the material is being supplied, especially when the carding machines V are supplied through the filling shaft feeder IV.

Figure 2:
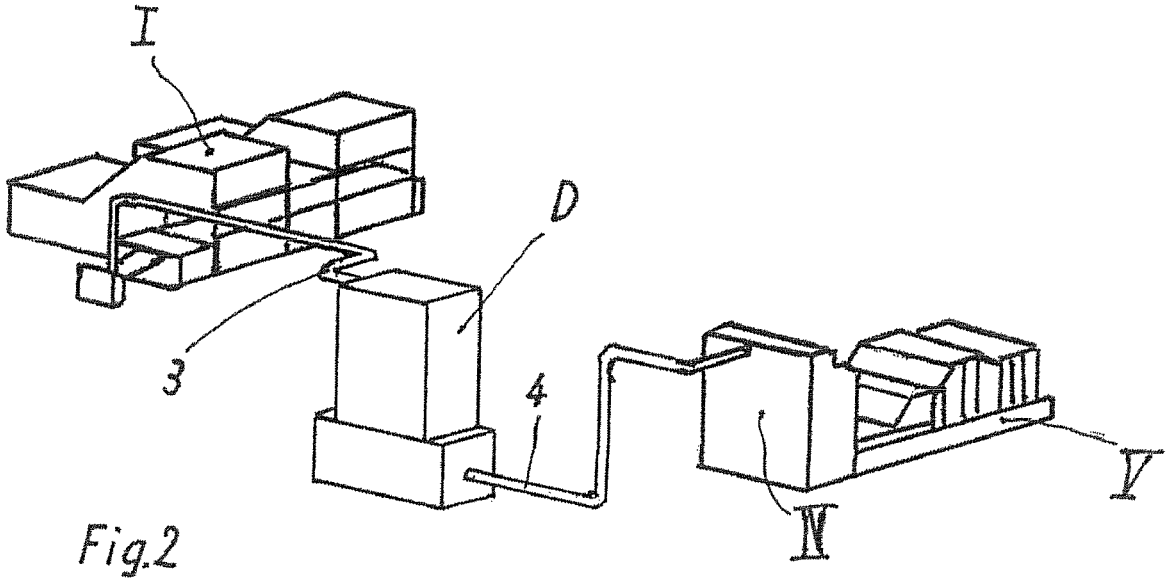
FIG. 2 A piece of equipment with the dosing opener according to the invention.
Figure 3:
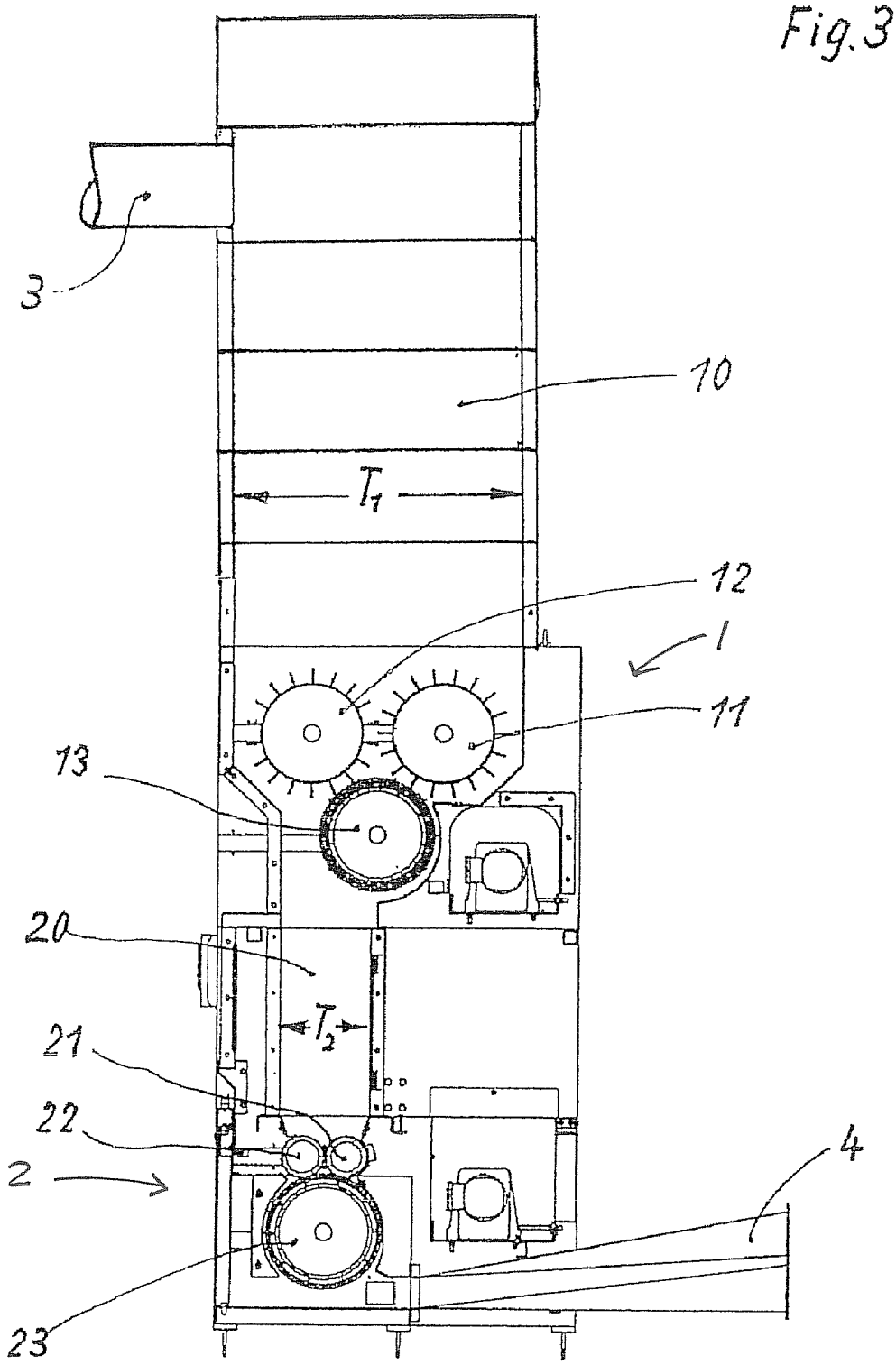
FIG. 3 A cross section through the dosing opener according to the invention.

As can be seen in FIG. 2, the machines II and III have been combined in the dosing opener D, which has a first opening step 1 (FIG. 3) and a second opening step 2 arranged on top of each other. The opening units 11, 12, 13 and 21, 22, 23 of these opening steps 1 and 2 are connected directly to each other via a filling shaft 20. The opening step 1 is equipped with a feeding shaft 10 that has a large storage volume so it can compensate for fluctuations in material. According to the invention, it has a large cross-sectional surface so that its usual construction height can store a 2 to 3 times larger volume of material. Even larger fluctuations of material have only a small effect on the height, so that the compression changes only slightly even if the height of the column of material fluctuates.

An opening unit consisting of two draw-in rollers 11 and 12 equipped with a selvedge card clothing has been arranged in the lower end of the feeding shaft 10 of the first opening step 1. The gap separating the draw-in rollers 11 and 12 can be changed so that the intermeshing of the selvedge card clothings can be adjusted for the supply of material. The adjustment can also cancel this intermeshing completely if the material requires it. The fiber material clamped in this way goes through the draw-in rollers 11 and 12 and is supplied in form of doses to an opening roller 13. This opening roller 13 has the pins that are customarily used for pre-opening rollers. Connected directly to this opening unit is a second feeding shaft 20 into which the opening roller 13 throws the pre-opened fiber material. This second feeding shaft 20 has a considerably smaller cross section than the feeding shaft 10 and is not as high either. Therefore, the fiber material is hardly compressed at all in this second feeding shaft—neither by air nor through a larger filling height—, thus remaining loose as if supplied through the pre-opening. In this state, the fiber material is grabbed at the lower end of the feeding shaft 20 by the draw-in rollers 21 and 22 that are also equipped with selvedge card clothings and sent to a precision opening roller 23 studded with a needle- or saw-toothed card clothing. The selvedges can also be directly milled into the draw-in roller. This is where the fine separation of the material takes place. Although the fiber quantity supplied by the draw-in rollers 21 and 22 is the same one that the opening roller 13 supplies to the feeding shaft 20, the draw-in rollers 21 and 22 run faster than the draw-in rollers 11 and 12, so that the fiber material is thinned and a certain distortion occurs that makes a very fine separation of the material possible. The fiber material that was finely opened like this is then pneumatically conveyed along a conduit 4 to the filling shaft IV so it can feed the carding machines V.

Since the fiber material is delivered to the feeding shaft 20 from the opening step 1 directly without interconnecting a pneumatic means of transportation, the feeding shaft 20 can be of very small size. The low construction height is not only advantageous for maintaining the state of separation generated by the opening step 1 but also makes it possible to arrange both opening steps on top of one another without needing a building that is higher than usual.

A controlling device controls the output after the second opening step of the dosing opener according to the needs of the filling shaft feeder IV. In addition, this controlling device also controls the delivery from the opening step 1 to the opening step 2 depending on the filling level of the filling shaft 20. As soon as this height leaves the set value, the supply coming from the opening step 1 is accelerated, reduced or totally cut off. The elimination of pneumatic transportation devices and the compact construction design of the opening steps 1 and 2 on top of one another achieve fast reactions when controlling the supply of material so that the filling level of the feeding shaft 20 barely fluctuates. The feeding shaft 20 does not need to compensate for fluctuations in the material, as this already occurs in the large feeding shaft 10 of the opening step 1. Thus, the feeding shaft 20 can be of very small size. For example, a height of 700 mm and a depth T2 of 300 mm are fully sufficient, even for material throughputs of 1,000-2,000 kg/h. On the other hand, the feeding shaft 10 has been designed for a sufficiently large reserve of material—for example, for a depth T1 of 1,000 mm with a height of 2,500 mm.

An overfill safety device has been foreseen for the feeding shaft 10 that starts functioning as soon as the filling height exceeds a certain level so that the feeding shaft 10 can no longer accept the fiber quantity supplied by the opening and mixing machines I. In large quantity throughputs of 1,000 kg per hour and higher, it is essential to have a correspondingly large reserve as well so downtimes or breakdowns in the supply coming from the opening and mixing machines 1 can be compensated. This is ensured by the feeding shaft 10 according to the invention with a relatively low fluctuation of the filling level. Pneumatic conveying devices between two machines always need longer reaction times at standstill and when the quantity of supplied material starts coming in or is changed. The direct coupling of the opening step 1 with the opening step 2 without pneumatic intermediate transportation ensures short reaction times and with them the corresponding security and guarantee for a constant filling level in the feeding shaft 20 as well. The latter can therefore be of a much smaller size than the feeding shaft 10. All these individual measures contribute to an exceptionally uniform making of fleece.

A comparison of conventional equipment with the one according to the invention pursuant to FIG. 2 reveals that the machines II and III are no longer needed and replaced by the dosing opener D. Conduits and the corresponding pneumatic conveying devices are also not needed, as the pre-opening step 1 and the fine-opening step 2 are arranged on top of one another and therefore the fiber material coming from the first opening step 1 is thrown directly into the feeding shaft of the second opening step 2. Apart from the compact design, it has been shown that the method according to the invention leads to an exceptionally good and uniform separation that allows uniform fleece production. The equipment fits in much smaller spaces. Complex installations for compressing the material with air irrespective of the filling height are no longer needed and occupational safety increases.

It should be appreciated by those skilled in the art that modifications and variations can be made to the embodiments described herein without departing from the scope of the appended claims.

The invention claimed is:

1. A method of opening and dosing fiber material, comprising:

feeding fiber material that has been opened or mixed in a first processing equipment to a dosing opener;

from the dosing opener, delivering the fiber material to a flock feeder of a carding machine or other downstream processing equipment;

in the dosing opener, processing the fiber material through a feeding shaft of a first opening step and delivering the fiber material from the first opening step directly into a feeding shaft of a second opening step without pneumatic conveyance between the first and second opening steps; and wherein the fiber material has essentially the same throughput in the first and second opening steps but is opened more finely in the second opening step than in the first opening step.

2. The method as in claim 1, wherein the mass of the fiber material is further thinned in the second opening step as compared to the first opening step.

3. The method as in claim 1, wherein the output of the fiber material in the second opening step is controlled as a function of demand of the downstream processing equipment.

4. The method as in claim 1, wherein a fill level of the fiber material in the feed shaft of the second opening step is maintained essentially constant by controlling delivery through the first opening step.

5. A device for opening and dosing fiber material in a fiber processing system wherein fiber material is feed to said device from processing equipment that opened or mixed the fiber material, said device comprising:

a first feeding shaft disposed to receive fiber material from the upstream processing equipment;

a first opening device disposed to receive fiber material directly from said first feeding shaft;

a second feeding shaft disposed under said first opening device to receive fiber material directly from said first opening device, said first feed shaft having a volume that is at least twice a volume of said second feeding shaft;

a second opening device disposed under said second feeding shaft to receive fiber material directly from said second feeding shaft; and said first and second opening devices arranged one above the other without intervening pneumatic conveyance of the fiber material between said opening devices.

6. The device as in claim 5, wherein said first opening device is a pre-opening unit, and the second opening device is a precision opening unit that further thins the fiber material as compared to the first opening unit.

7. The device as in claim 6, wherein said second opening device has a delivery speed that is higher than a delivery speed of said first opening device such that the fiber material is thinned in the second opening device for the same throughput.

8. The device as in claim 5, wherein said first feeding shaft has a cross-sectional depth that is at least 2.5 times greater than a cross-sectional depth of said second feeding shaft.

9. The device as in claim 5, wherein said first feeding shaft has a height that is at least 3 times greater than a height of said second feeding shaft.

10. The device as in claim 5, further comprising a control device configured to maintain a filling level in said second feeding shaft essentially constant by controlling delivery through said first opening device.

11. The device as in claim 5, wherein said first opening device comprises a pair of draw-in rollers immediately upstream of a pre-opening roller.

12. The device as in claim 11, wherein said draw-in rollers have intermeshing card clothing, and are adjustable to vary a gap between said draw-in rollers through which the fiber material is conveyed.

13. The device as in claim 12, wherein said pre-opening roller is studded with opening pins.

14. The device as in claim 12, wherein said draw-in rollers have selvedge card clothing.

15. The device as in claim 5, wherein said second opening device comprises an opening roller studded with needle or saw-tooth card clothing.

* * * * *